US009297151B2

(12) United States Patent
Blessing et al.

(10) Patent No.: US 9,297,151 B2
(45) Date of Patent: Mar. 29, 2016

(54) SANITARY CONDUIT, IN PARTICULAR FOR A SHOWER DEVICE

(71) Applicant: Hansgrohe SE, Schiltach (DE)

(72) Inventors: Gerd Blessing, VS-Obereschach (DE); Bernd Werner, Obemdorf-Beffendorf (DE)

(73) Assignee: Hansgrohe SE, Schiltach (DE)

( * ) Notice: Subject to any disclaimer, the term of this patent is extended or adjusted under 35 U.S.C. 154(b) by 82 days.

(21) Appl. No.: 14/200,092

(22) Filed: Mar. 7, 2014

(65) Prior Publication Data

US 2014/0251454 A1 Sep. 11, 2014

(30) Foreign Application Priority Data

Mar. 7, 2013 (DE) ..... 10 2013 203 946

(51) Int. Cl.
*E03C 1/02* (2006.01)
*E03C 1/04* (2006.01)
*E03C 1/06* (2006.01)

(52) U.S. Cl.
CPC ..... *E03C 1/025* (2013.01); *E03C 1/0408* (2013.01); *E03C 1/06* (2013.01); *Y10T 137/698* (2015.04)

(58) Field of Classification Search
CPC ... Y10T 137/698; E03C 1/025; E03C 1/0408; E03C 1/021; C03C 1/06; A47K 3/28
USPC ..... 4/614, 596, 600; 137/360, 801
See application file for complete search history.

(56) References Cited

U.S. PATENT DOCUMENTS

| | | | | |
|---|---|---|---|---|
| 3,333,284 | A | 8/1967 | Symmons | |
| 5,121,511 | A * | 6/1992 | Sakamoto et al. | 4/601 |
| 5,321,860 | A | 6/1994 | Steinhardt et al. | |
| 5,365,620 | A * | 11/1994 | MacLeod | 4/615 |
| 5,499,767 | A | 3/1996 | Morand | |
| 5,983,419 | A * | 11/1999 | Carroll | 4/615 |
| 6,038,715 | A * | 3/2000 | Flieger et al. | 4/601 |
| 7,657,949 | B2 * | 2/2010 | Zhadanov et al. | 4/615 |
| 2009/0222983 | A1 * | 9/2009 | Bosio | 4/596 |
| 2009/0320203 | A1 | 12/2009 | Chen | |
| 2010/0024909 | A1 * | 2/2010 | Lu | E03C 1/06 137/861 |
| 2010/0276020 | A1 | 11/2010 | Fan et al. | |
| 2013/0042937 | A1 * | 2/2013 | Cai | E03C 1/0408 137/861 |

FOREIGN PATENT DOCUMENTS

| | | | |
|---|---|---|---|
| DE | 3434735 | A1 | 4/1986 |
| DE | 102010024106 | A1 | 12/2011 |

(Continued)

OTHER PUBLICATIONS

Search report dated May 16, 2014 in EPO application 14157879.9.

(Continued)

*Primary Examiner* — Kevin Lee
(74) *Attorney, Agent, or Firm* — Duane Morris LLP

(57) ABSTRACT

A sanitary conduit, in particular for a shower device, is useful, for example, as a shower arm conduit in a shower system. The sanitary conduit has a rigid, hollow conduit housing including a base body (10′*a*) and a housing wall removably attached to the base body. At least one flexible conduit (12*a*, 12*b*) is inserted in the hollow conduit housing and is made from a flexural conduit material.

13 Claims, 5 Drawing Sheets

(56) References Cited

FOREIGN PATENT DOCUMENTS

| | | | |
|---|---|---|---|
| EP | 1589154 | A2 | 10/2005 |
| EP | 1712170 | A1 | 10/2006 |
| FR | 2692465 | A1 | 12/1993 |
| WO | 9308724 | A1 | 5/1993 |
| WO | 9802077 | A1 | 1/1998 |

OTHER PUBLICATIONS

Official Action of Jan. 14, 2014 in DE 10 2013 203 946.8.

* cited by examiner

SANITARY CONDUIT, IN PARTICULAR FOR A SHOWER DEVICE

BACKGROUND OF THE INVENTION

The invention relates to a sanitary conduit, such as can be used in particular as a shower arm conduit for a shower device.

SUMMARY OF THE INVENTION

A common type of shower arm is a hollow shower arm composed of brass, the hollow duct of which functions as a water-conducting duct to a shower head mounted thereon. Such shower arms composed of a brass housing are of relatively high weight. The water that is conducted through comes in direct contact with the brass housing material.

The invention is based on the technical problem of providing a sanitary conduit that can be realized with relatively low weight and by means of which water that is conducted through can be prevented from coming into contact with a housing metal.

The invention solves said problem through the provision of a sanitary conduit having the features disclosed and claimed. Said sanitary conduit has a rigid, hollow conduit housing with a base body and a housing wall attached to said base body. At least one flexible conduit made from a flexural conduit material is inserted into the hollow conduit housing.

The insertion of the flexible conduit into the hollow conduit housing can be performed without problems before the conduit housing is closed by the attachment of the housing wall to the base body. The inserted conduit functions as a water-conducting duct and prevents the water that is conducted through from coming into any contact whatsoever with the typically metallic material of the conduit housing. For example, the conduit housing may be manufactured as a hollow, pressure die cast zinc part. It is particularly advantageous for flexural material to be used for the inserted conduit. This is because, in this way, the conduit can flexibly follow any desired, for example curved or angled, profile of the conduit housing, without the need for said conduit to have previously been precisely adapted in terms of form and length to the form of the conduit housing, such as would be the case if, alternatively, use were made of a rigid pipe part composed of metal or synthetic material.

Advantageous alternative refinements of the invention include the use of a flexural synthetic material hose conduit or a flexural metal conduit for the flexible conduit.

In one refinement of the invention, the sanitary conduit has means for fixing or lateral guidance of the respective flexible conduit. In this way, the conduit can be held in a defined position in the conduit housing.

In one refinement of the invention, the sanitary conduit has, on at least one end of the flexible conduit, a connection nipple which is preferably composed of a rigid synthetic or metal material.

In one refinement of the invention, multiple flexible conduits are arranged fluidically in parallel and juxtaposed in the conduit housing. In this way, it is for example possible for hot water and cold water to be conducted separately in the sanitary conduit, or shower water can be conducted separately to separate shower jet regions of a coupled-on shower device. In a further refinement, a multi-connection nipple is provided which has multiple connection openings which are coupled to an end of in each case one of the flexible conduits. The connection openings are connected fluidically to a common outlet or inlet opening or alternatively to separate outlet or inlet openings of the multi-connection nipple. In the former case, water supplied via the inlet opening can be distributed between the multiple connected flexible conduits, or water supplied separately via the flexible conduits can be merged in the multi-connection nipple. In the latter case, water can be supplied separately to separate shower jet regions via the outlet openings.

In one advantageous refinement of the invention, the sanitary conduit includes a shower arm conduit for a shower device. In a further refinement, in the case of a shower arm conduit of said type, the multi-connection nipple forms a connection for the coupled flexible conduits to a shower head of the shower device.

In one refinement of the invention, out of the plurality of the fluidically parallel flexible conduits, a first conduit can be coupled to a first shower jet region of the shower device and a second conduit can be coupled to a second shower jet region which is separate from the first region. This makes it possible for shower water to be conducted separately in the sanitary conduit to the various shower jet regions. If the multi-connection nipple is provided at the outlet side, the flexible conduits can be coupled via said multi-connection nipple to the separate shower regions.

In a further refinement of the invention, for use in a shower device, the sanitary conduit comprises a shower-wall-side section and a shower arm section that extends at an angle with respect to said wall-side section. Accordingly, it is possible for the shower-wall-side section to be provided, for example, for being mounted in a substantially vertically running manner on a fixed wall of a shower, whereas the shower arm section projects in a substantially horizontally running manner from said wall and bears the shower head.

BRIEF DESCRIPTION OF THE DRAWINGS

Advantageous embodiments of the invention are illustrated in the drawings and will be described below. In the drawings.

DETAILED DESCRIPTION

Figure 1:
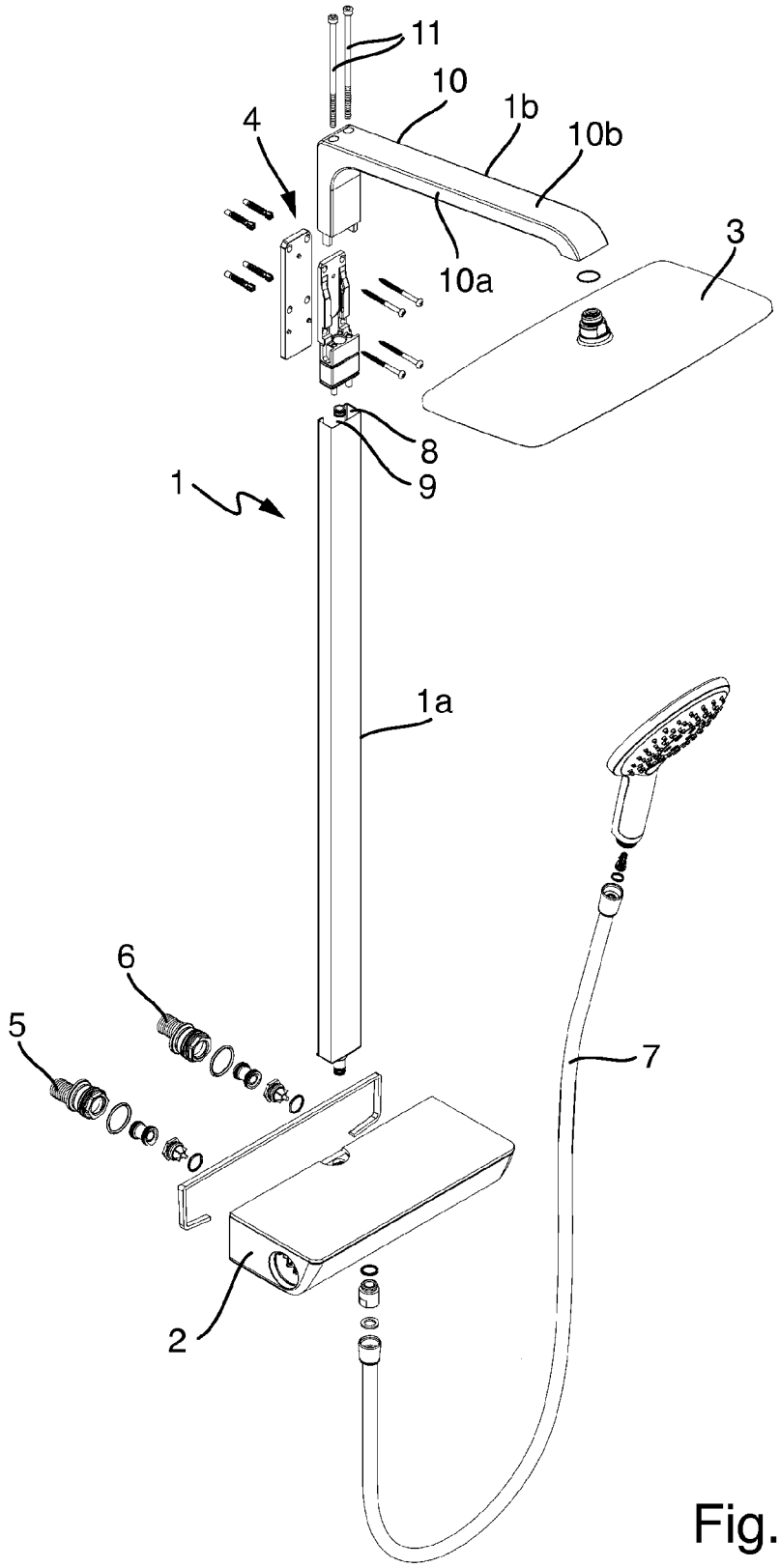
FIG. 1 shows a perspective, exploded assembly view of a shower device system with a single-duct supply of water to a shower head.

The shower device system illustrated in a perspective, exploded assembly view in FIG. 1 comprises a sanitary conduit 1 according to the invention, which leads from a mixer fitting 2 to a shower head 3 and which is assembled, in two parts, from a wall-side section 1*a* and a shower arm section 1*b* that projects substantially perpendicularly from said wall-side section. The two sections 1*a*, 1*b* are coupled to one another by means of a wall bracket 4 by which the sanitary conduit 1 can be fastened in the conventional way to a fixed wall of a shower room, such that the wall-side section 1*a* extends substantially vertically and the shower arm section 1*b* extends substantially horizontally.

The mixer fitting 2 which is merely schematically indicated here has, as is conventional, two separate water inlets 5, 6 for cold water and hot water respectively, and a means (not shown) for flow rate and temperature regulation, with which the user can adjust the water flow rate and the water temperature. A hand-held shower 7 is also connected to the mixer fitting 2 in a conventional way.

In the exemplary embodiment of FIG. 1, the mixing of cold water and hot water takes place in the mixer fitting 2, and the corresponding mixed water is conducted to the hand-held shower 7 and to the shower head 3. The supply to the shower head 3 takes place through the sanitary conduit 1, which in this case is correspondingly of single-duct configuration. For this purpose, the wall-side section 1*a* of said sanitary conduit has a rigid, hollow wall section conduit housing 8 which is manufactured for example from pressure die cast zinc and into which there is inserted a single flexible conduit 9 composed of a flexural conduit material such as a flexural synthetic hose material or a flexural metal material. The wall section conduit housing 8 has a substantially rectangular cross section and, along its wall side, is open over a width that enables the flexible conduit 9 to be inserted into the housing cavity, such that said flexible conduit does not need to be pushed in axially from the housing end side.

The shower arm conduit section 1*b* likewise comprises a rigid, hollow conduit housing 10 which is manufactured for example as a pressure die cast zinc part and into which a flexible conduit composed of a flexural conduit material (not shown) is inserted. Said flexible conduit issues at the outlet side into the shower head 3, and is coupled at the inlet side, by means of a conventional conduit connection in the region of the wall bracket 4, to the outlet-side end of the conduit 9 that is received in the wall conduit section 1*a*.

The conduit housing 10 of the shower arm section 1*b* is composed of a base body 10*a* and of a housing wall which is realized in this case as a top-side housing cover 10*b* and which is removably attached to the base body 10*a* by means of screw connections 11. With the housing cover 10*b* removed, the flexible shower arm conduit is inserted into the shower arm base body 10*a*, wherein, in the angled region of the base body 10*a*, said flexible shower arm conduit is correspondingly bent through approximately 90°. Through the use of flexural conduit material, the bend can be produced as the flexible conduit is inserted into the housing base body 10*a*, such that it is not necessary for a conduit to be prefabricated with said bend. After the insertion of the flexible conduit, the housing cover 10*b* is mounted onto the base body 10*a* and is fixed thereto by means of the screw connections 11. Depending on requirements, the inserted conduit may be fixed to the housing base body 10*a*, or at least laterally guided, by means of corresponding fixing or guidance means. The shower arm conduit and the wall-side conduit 9 may each be provided, on the ends, with suitable connection nipples in order for said conduits to be connected to one another and/or or in order to provide suitable connections to the shower head 3 at one side and to the mixer fitting 2 at the other side.

Figure 2:
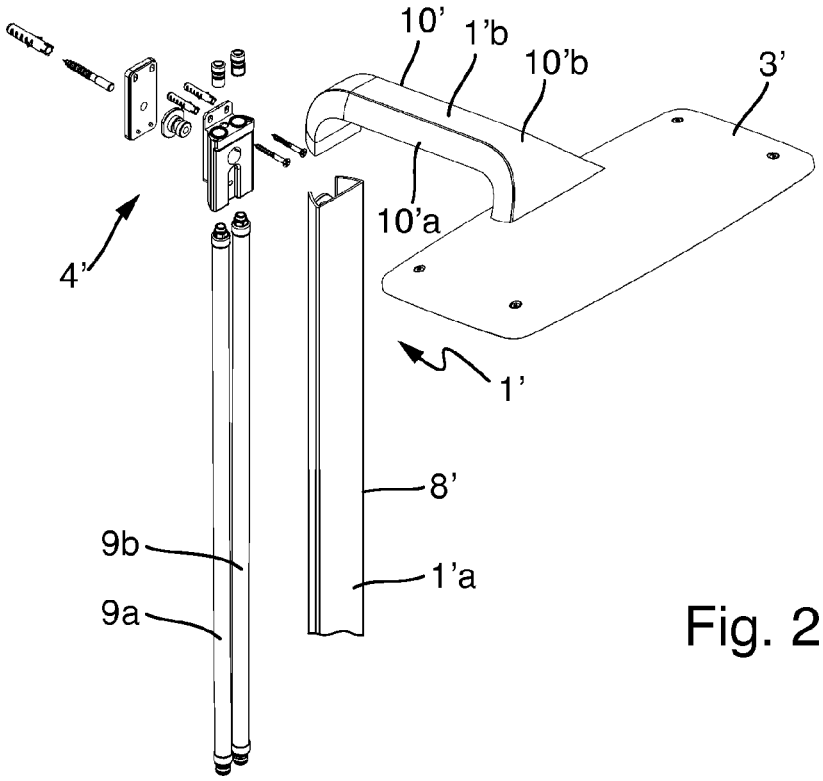
FIG. 2 shows a perspective, exploded assembly view of a part of a variant of the shower device system of FIG. 1, with a two-duct supply of water to a shower head.
Figure 3:
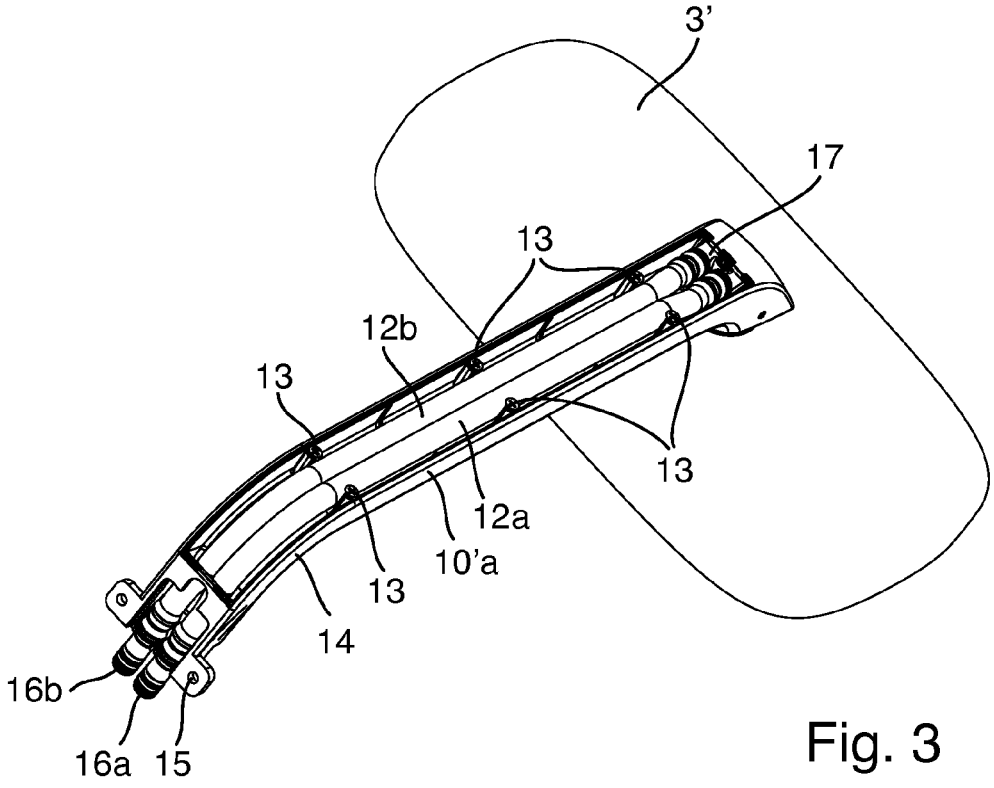
FIG. 3 shows a perspective view of a shower arm with mounted shower head of the shower device system of FIG. 2, with a shower arm cover removed.

FIGS. 2 and 3 illustrate a variant of the shower system of FIG. 1 with the components of interest here. In this system variant, shower water is conducted from a mixer fitting separately to two different shower jet regions of a shower head 3'. For this purpose, the shower system of FIGS. 2 and 3 has a sanitary conduit 1' according to the invention in a two-duct configuration. Similarly to the system of FIG. 1, the sanitary conduit 1' is composed of a wall-side section 1'*a* and of a shower-head-side shower arm section 1'*b*, said sections being mechanically and fluidically coupled to one another by means of a wall bracket 4'. The wall-side section 1'*a* again comprises a rigid, hollow conduit housing 8' which is designed to be open on its wall side, such that two parallel flexible conduits 9*a*, 9*b* can be inserted from said side.

Analogously, the shower arm section 1'*b* comprises a rigid, hollow conduit housing 10' which is composed for example of pressure die cast zinc and which has a base body 10'*a* and a housing cover 10'*b* mounted and fixed on said base body. FIG. 3 shows the shower arm base body 10'*a*, with shower head 3' mounted thereon, in a version which is merely artistically slightly modified in relation to the system of FIG. 2. In the view of FIG. 3, the housing cover 10'*b* has been removed, whereby it can be seen that, and how, two separate, parallel flexible conduits 12*a*, 12*b* have been inserted into the shower arm housing base body 10'*a*. Here, said flexible conduits are laterally guided by webs 13 which are formed opposite one another in pairs on inner side walls of the housing base body 10'*a* and which, where required, also serve to provide screw openings into which screws can be screwed for example for the fastening of the housing cover 10'*b*. In addition or alternatively, the flexible conduits 12*a*, 12*b* may be fixed to the housing base body 10'*a* by corresponding fixing means.

Since the flexible conduits 12*a*, 12*b* are manufactured from flexural synthetic or metal material, they can easily follow a bend 14 by which the shower arm 10'*a*, when in an installed state in a shower, transitions from an approximately vertical, inlet-side profile into an obliquely forwardly directed profile with a horizontal main component. In the variant shown in FIG. 3, there is provided on the inlet-side end of the shower arm 10'*a* a connection element 15 by means of which the shower arm 10'*a* can be coupled to a wall-side conduit section or can be directly fastened to a wall of a shower room. At said inlet-side end, the flexible conduits 12*a*, 12*b* terminate with in each case one connection nipple 16*a*, 16*b*. At the opposite, shower-head-side end, the flexible conduits 12*a*, 12*b* issue into a double connection nipple 17.

Figure 4:
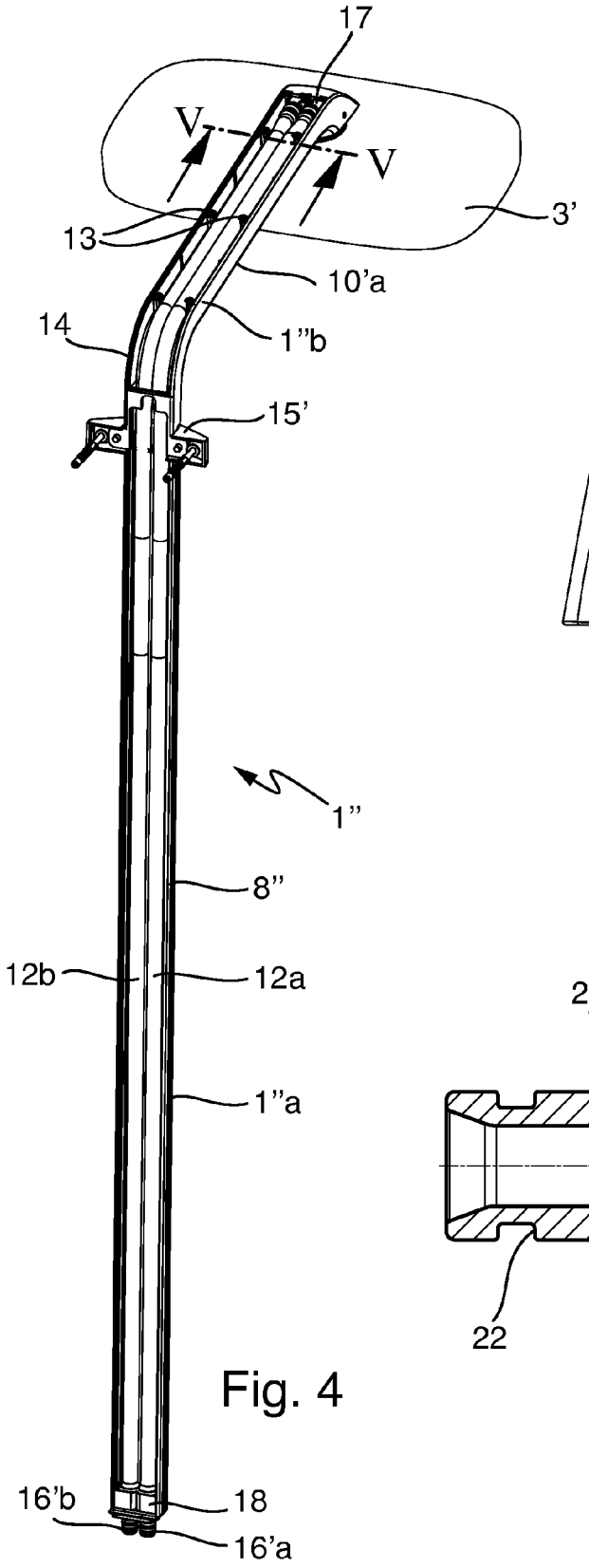
FIG. 4 shows a perspective view of a variant of the shower device system of FIG. 2 in the case of a wall bar-shower arm design, with a shower arm cover removed.

FIG. 4 shows a variant of the system of FIGS. 2 and 3 in which use is made of a sanitary conduit 1" according to the invention whose two flexible conduits 12*a*, 12*b* composed of flexural conduit material are led, in integral form, from a mixer fitting (not shown) to the shower head 3', wherein, for ease of understanding, the same reference signs as those in FIGS. 2 and 3 are used for functionally equivalent but not necessarily identical elements. In other words, the two flexible conduits 12*a*, 12*b* for two separate shower jet regions extend along a wall-side section 1"*a* and an adjoining shower arm section 1"*b*. For this purpose, the wall-side section 1"*a* comprises a rigid, hollow conduit housing 8" which is open on the wall side and which is connected to the housing base body 10'*a* of the shower arm section 1"*b* by means of a connecting element 15'. The connecting element 15' simultaneously serves as a wall bracket for the fastening of the sanitary conduit 1" to the wall of a shower room. Alternatively, the wall-side conduit housing 8" may be formed integrally with the housing base body 10'*a* of the shower arm section 1"*b*.

At the inlet-side end, the two flexible conduits 12*a*, 12*b* are again provided with in each case one connection nipple 16'*a*, 16'*b*, by means of which they can be connected to the mixer fitting (not shown). Means 18 for guidance or fixing of the two connection nipples 16'*a*, 16'*b* are provided on the corresponding end region of the wall-side conduit housing 8".

Figure 5:
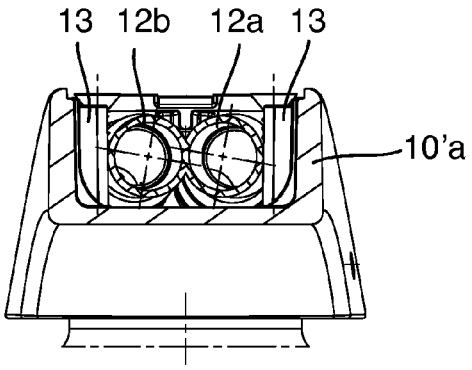
FIG. 5 shows a cross-sectional view through the shower arm along a line V-V of FIG. 3.

It can be seen from FIG. 5 how the two parallel flexible conduits 12*a*, 12*b* are accommodated, abutting tightly against one another and guided laterally by the webs 13, in the housing base body 10'*a* of the shower arm section. Here, FIG. 5 shows a cross section at a level a short distance in front of the point at which the two flexible conduits 12*a*, 12*b* issue into the double connection nipple 17.

The two-duct configuration of the sanitary conduit as described above with regard to FIGS. 2 to 5 can thus be utilized for supplying shower water that has been mixed in a mixer fitting separately to two separate shower jet regions of a correspondingly configured shower head, which, by means of said separate shower jet regions, enables different shower jet characteristics to be set. Alternatively, by means of said configuration, cold water or hot water can be conducted separately, or shower water that has been mixed in a mixer fitting can be conducted in parallel via the two conduit ducts to a common shower jet region of the shower head. In the latter case, the water can be conducted to the shower head with twice the flow rate capacity in relation to the use of only one conduit of equal throughflow cross section.

It is self-evident that the invention also encompasses multi-duct sanitary conduits with three or more fluidically parallel flexible conduits composed of flexural conduit material. These may for example be used for supplying water individually to each of three or more separate shower jet regions of a correspondingly configured shower head. If required, corresponding multi-connection nipples with three or more connection openings for the three or more flexible conduits may be provided instead of the above-mentioned double connection nipple.

Figure 6:
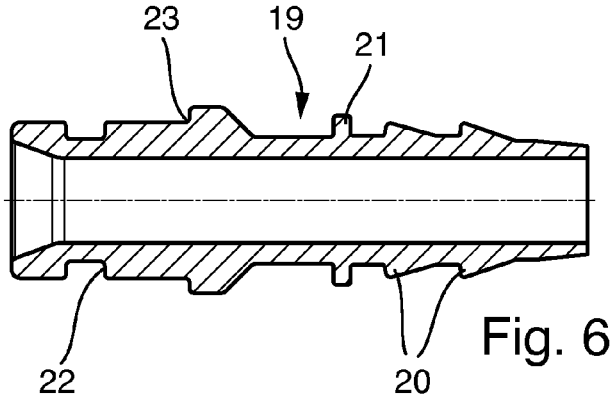
FIG. 6 shows a longitudinal sectional view through a connection nipple that can be used for a shower arm conduit of the shower device systems of FIGS. 1 to 4.

FIG. 6 shows, in a longitudinal section, a connection nipple 19 such as can be used for the sanitary conduit according to the invention, for example as the inlet-side connection nipple 16*a*, 16*b*, 16'*a*, 16'*b* in the shower systems of FIGS. 2 to 4. The connection nipple 19 is equipped, in a right-hand region in FIG. 6, with a fir-tree-shaped hose retention profile 20, and has, adjacent to the latter, a stop ring 21. The connection nipple 19 is inserted with its conduit retention profile 20 into an associated flexible conduit as far as the stop ring 21. On its left-hand side in FIG. 6, the connection nipple 19 has an annular groove 22 for the insertion of an annular seal, and has an external profile 23 by means of which it can be guided or fixed for example on a housing region of the associated sanitary conduit.

Figure 7:
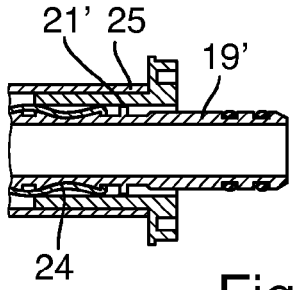
FIG. 7 shows a longitudinal sectional view of a conduit-connection nipple coupling.

FIG. 7 shows a longitudinal sectional view of a similar connection nipple 19', which can be used for a sanitary conduit according to the invention, in an installed position. As can be seen from FIG. 7, the nipple 19' is inserted by way of a fir-tree-shaped retention profile into the end of a flexible conduit 24 as far as a stop ring 21'. A surrounding clamping sleeve element 25 secures the connection of flexible conduit 24 and connection nipple 19'.

Figure 8:
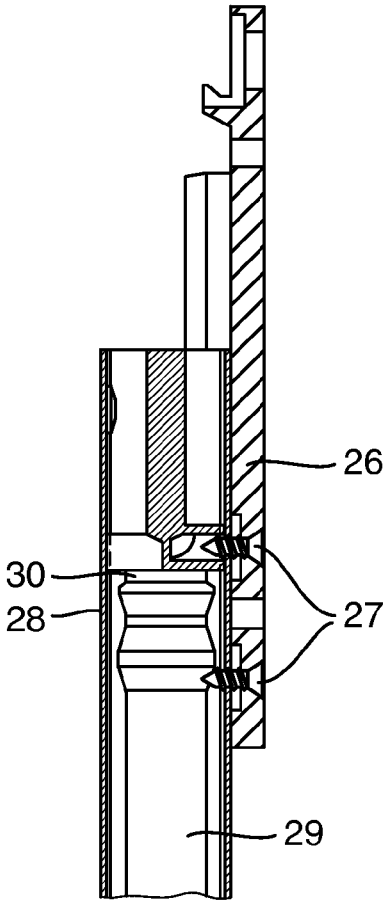
FIG. 8 shows a longitudinal sectional view of a wall bracket that can be used for the systems of FIGS. 1 to 7.

FIG. 8 shows an exemplary embodiment in which a wall bracket element 26 is fastened by means of screw connections 27 to a hollow conduit housing section 28, which is part of a sanitary conduit according to the invention and into which, in turn, at least one associated flexible conduit 29 composed of a flexural conduit material is inserted. The flexible conduit 29 is mounted, at the end shown, onto a connection nipple 30. Here, as can be seen from FIG. 8, the screw connections 27 serve simultaneously for holding the connection nipple 30 in the conduit housing 28 and for securing the connection of flexible conduit 29 and connection nipple 30.

Figure 9:
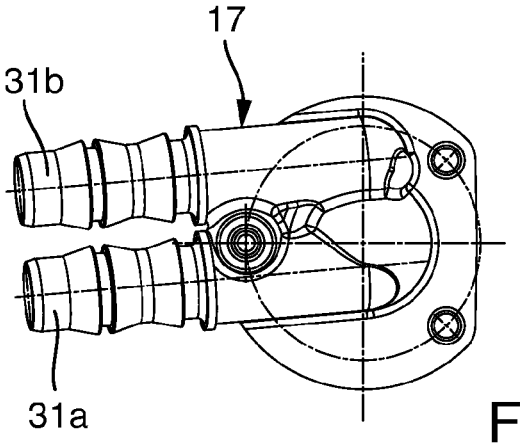
FIG. 9 shows a plan view from above of a double connection nipple that can be used for example for the systems of FIGS. 2 to 5 with two-duct water supply.
Figure 10:
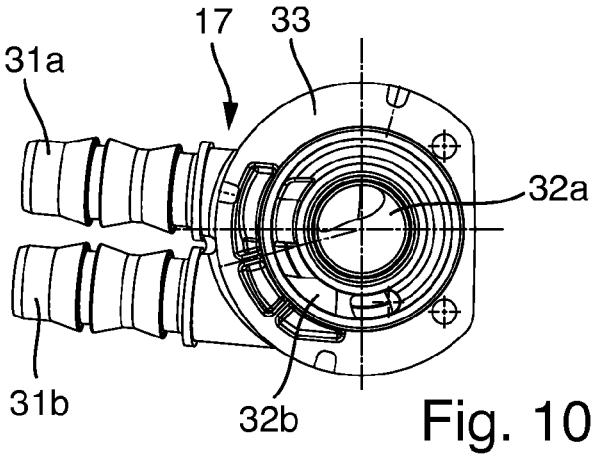
FIG. 10 shows a plan view from below of the double connection nipple of FIG. 9.

FIGS. 9 and 10 illustrate an advantageous embodiment for the above-mentioned double connection nipple 17, via which, in the case of the two-duct shower arm embodiment, the two separate flexible conduits 12*a*, 12*b* issue into the shower head 3' and which may for example be manufactured from a flexurally rigid synthetic material. As can be seen from said figures, the double connection nipple has two connection openings 31*a*, 31*b* running substantially parallel and has two corresponding outlet openings 32*a*, 32*b* into which in each case one of the two connection openings 31*a*, 31*b* issues and which issue from the nipple 17 substantially perpendicular to the connection openings 31*a*, 31*b*. Here, the outlet opening 32*a* forms a central duct, and the outlet opening 32*b* forms an annular duct. On the double connection nipple 17 there is integrally formed a substantially annular flange 33 by means of which the nipple 17 can be fixed to the associated shower head. Then, when the nipple 17 is in the installed state, the two separate outlet openings 32*a*, 32*b* lead to the different associated shower jet regions of the shower head.

Figure 11:
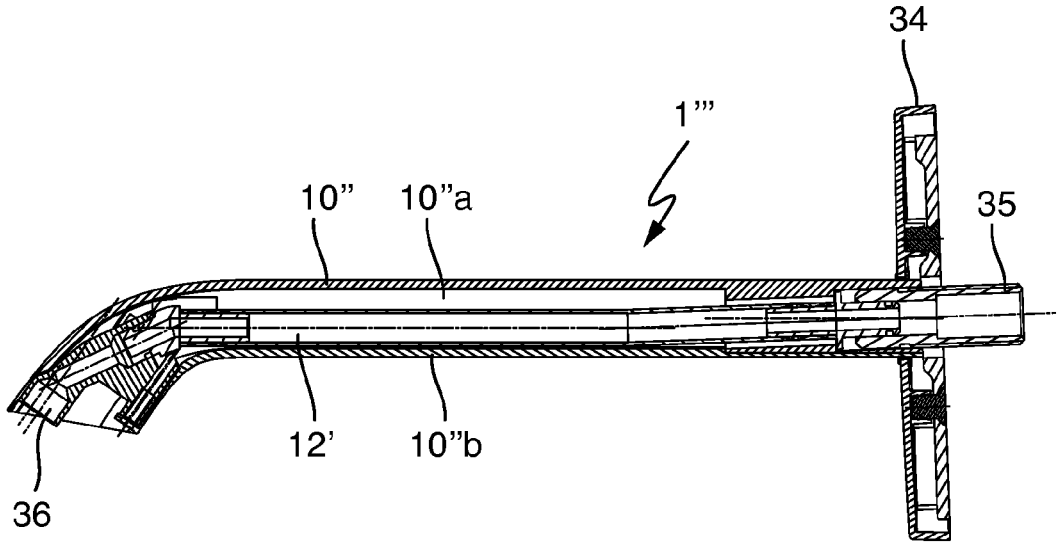
FIG. 11 shows a longitudinal sectional view of a sanitary conduit designed as a directly wall-mountable shower arm.
Figure 12:
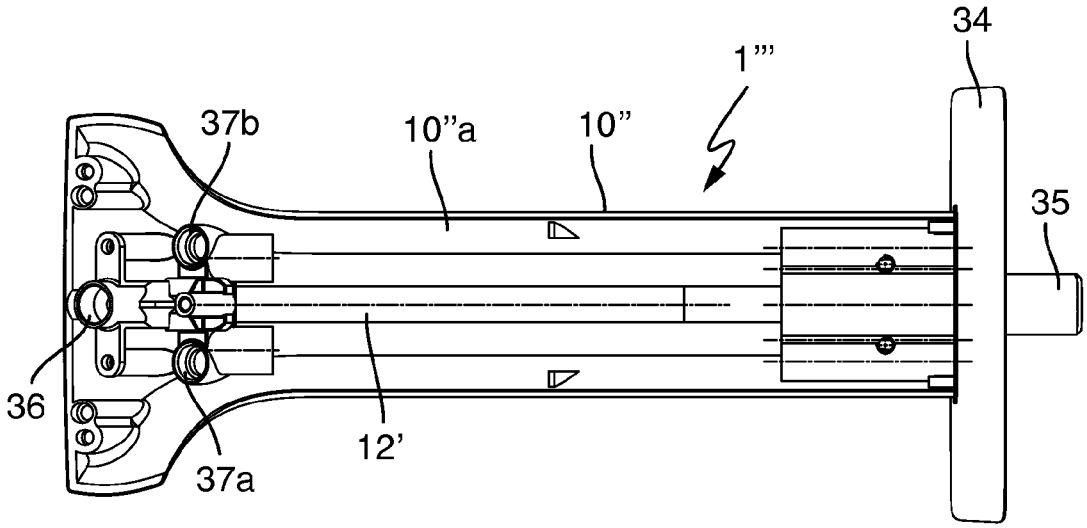
FIG. 12 shows a view from below of the shower arm of FIG. 11, with a housing cover removed.

FIGS. 11 and 12 illustrate, as a further exemplary embodiment of the invention, a sanitary conduit that is formed as a directly wall-mountable shower arm 1'". For this purpose, the shower arm 1'" has, in a rear end region, a mounting plate 34 by means of which it can be fastened directly to a shower room wall so as to project substantially horizontally from said wall in the installed state. Rearwardly, the shower arm 1'" projects beyond the mounting plate 34 by way of a connection pipe piece 35 via which said shower arm can be connected to a connector, situated in the wall, of a concealed water supply.

The shower arm 1'" comprises a hollow conduit housing 10" which is manufactured for example from pressure die cast zinc and which has a base body 10"*a* and a housing wall removably attached to said base body, which housing wall in this case forms an underside housing cover 10"*b*. A flexible conduit 12' composed of flexural synthetic or metal material is inserted into the hollow conduit housing 10", wherein said conduit is joined in a fluid-tight manner by way of its rear end into the connection pipe piece 35. At its front end, the conduit issues into a shower-head-side outlet 36 of the shower arm 1'". As can be seen in particular from the view of the underside in FIG. 12, the shower arm 1'" is prefabricated with two further outlets 37*a*, 37*b*, which in the present case remain unused. In alternative applications of said shower arm 1'", said further outlets 37*a*, 37*b* may likewise be assigned in each case one flexible conduit in the manner of the flexible conduit 12', which further flexible conduits are then additionally inserted into the hollow conduit housing 10". In this way, it is then possible for, for example, three different shower jet regions of a shower head that is coupled to the front end of the shower arm 1'" to be supplied individually with water.

As is made clear by the exemplary embodiments that are shown and explained above, the invention provides a sanitary conduit which is suitable inter alia as a shower arm conduit for shower device systems. In the case of the sanitary conduit according to the invention, the conducting of water is performed by one or more flexible conduits composed of a flexural conduit material, said conduits being inserted into a rigid, hollow conduit housing. Compared with conventional sanitary conduits composed of a brass body with a water-conducting hollow duct, the sanitary conduit according to the invention can be manufactured with a considerably lower weight. Furthermore, with the sanitary conduit according to the invention, it is possible for the water that is conducted through to be prevented from coming into any contact whatsoever with metal material of a conduit housing. The provision of corresponding shower arms for shower systems constitutes a particular advantageous possible use of the invention, though it is self-evident that the sanitary conduit according to the invention may also be used for other applications in sanitary engineering in which the stated properties are desirable. The conduit housing for the sanitary conduit according to the invention can be produced with relatively little outlay, for example as a pressure die cast zinc part.

What is claimed is:

1. A sanitary conduit for a shower device, comprising:

a rigid, hollow conduit housing provided with a connection to a head shower configured to be mounted at a shower room wall, said conduit housing comprising a base body and a housing wall removably attached to said base body, and at least one flexible conduit comprising a flexural conduit material, wherein the conduit is inserted in the hollow conduit housing, wherein a housing wall of at least one of a shower arm section and a shower arm, leading to the head shower of the sanitary conduit, forms one of a top-side housing cover and an underside housing cover on the hollow conduit housing.

2. The sanitary conduit according to claim 1, wherein the flexible conduit comprises one of a flexural synthetic material hose conduit and a flexural metal conduit.

3. The sanitary conduit according to claim 1, further comprising a structure for one of fixing and lateral guidance of the at least one conduit in the conduit housing.

4. The sanitary conduit according to claim 1, further comprising at least one connection nipple coupled to an end of the at least one conduit.

5. The sanitary conduit according to claim 1, wherein a plurality of said flexible conduits are arranged fluidically in parallel and juxtaposed in the conduit housing.

6. The sanitary conduit according to claim 5, further comprising a multi-connection nipple having a plurality of connection openings which are coupled to an end of in each case one of the flexible conduits, and having a common opening as one of an outlet and inlet opening for at least one of the connection openings.

7. The sanitary conduit according to claim 6, further comprising a shower arm conduit of a shower device.

8. The sanitary conduit according to claim 7, wherein the multi-connection nipple forms a connection for the coupled flexible conduits to a shower head of the shower device.

9. The sanitary conduit according to claim 7, wherein out of the plurality of flexible conduits, a first conduit is couplable to a first shower jet region of the shower device and a second conduit is couplable to a second shower jet region of the shower device separate from the first region.

10. The sanitary conduit according to claim 8, wherein for use in the shower device, said conduit comprises a shower wall sided section and a shower arm section extending in an angled manner relative to said wall sided section.

11. The sanitary conduit according to claim 5, further comprising a multi-connection nipple having a plurality of connection openings that are coupled to an end of in each case one of the flexible conduits, and having separated openings for the connection openings.

12. The sanitary conduit according to claim 1, further comprising a shower arm conduit of a shower device.

13. The sanitary conduit according to claim 8, wherein out of the plurality of flexible conduits, a first conduit is couplable to a first shower jet region of the shower device and a second conduit is couplable to a second shower jet region of the shower device separate from the first region.

* * * * *